United States Patent [19]

Hardy

[11] 4,163,522

[45] Aug. 7, 1979

[54] OSCILLATING MECHANISM

[75] Inventor: Charles T. Hardy, Wilton Manors, Fla.

[73] Assignee: Safe-T-Lawn, Inc., Hialeah, Fla.

[21] Appl. No.: 791,851

[22] Filed: Apr. 28, 1977

[51] Int. Cl.[2] ..... B05B 3/00

[52] U.S. Cl. ..... 239/230

[58] Field of Search ..... 239/230–233

[56] References Cited

U.S. PATENT DOCUMENTS

| | | | |
|---|---|---|---|
| 2,691,547 | 10/1954 | Campbell | 239/231 X |
| 3,022,012 | 2/1962 | Sharp et al. | 239/230 |
| 3,606,163 | 9/1971 | Lewis | 239/230 |

FOREIGN PATENT DOCUMENTS

| | | | |
|---|---|---|---|
| 1172466 | 6/1964 | Fed. Rep. of Germany | 239/230 |

*Primary Examiner*—John J. Love

*Attorney, Agent, or Firm*—Malin & Haley

[57] ABSTRACT

In an improved oscillating arm mechanism including a fluid engaging member for contact with a fluid sprinkler stream to move a distal portion of the member into and away from the fluid stream. The fluid engaging member includes at least two surfaces on its distal portion for moving the member into and away from the fluid stream. A walling surface is used to wall the member onto the stream and for driving the member further into the fluid stream. A repelling surface is used to provide a disengaging or repelling force to drive the member out of the stream and to begin another cycle of operation. Further, the fluid engaging member provides an exit channel means on the side opposite the two or more surfaces of the device to allow maximum fluid flow of the fluid stream to continue its original direction during engagement and disengagement of the member and the fluid stream.

9 Claims, 9 Drawing Figures

OSCILLATING MECHANISM

BACKGROUND OF THE INVENTION

The prior art has not taught the present invention. In U.S. Pat. No. 3,767,119 to Edward Tebbals, Jr., a fluidic device is described. This sprinkler device uses surfaces in combination with a fluid oscillator to change the fluid direction.

BRIEF DESCRIPTION OF THE INVENTION

This is an oscillating device for operation by a fluid stream and includes an oscillating member movable relative to the fluid stream. The oscillating member is connected to the device. The member including a walling means and at least one dewalling means. The walling means is a surface and the dewalling means is a surface. The member may be an article. The walling means is connected to the member to provide a downstream that creates the walling force. The walling force moves the member into engagement with the fluid stream when the member is placed near the fluid stream and at least a portion of the walling means into the fluid stream. The said dewalling means is connected to the member and is moved into the fluid stream by the walling means. The dewalling means provides a dewalling force when placed in the fluid stream. The dewalling means moves the member in a direction generally opposite to the inward movement of the member into the fluid stream. The dewalling force overcomes the walling force and moves the member out of the fluid stream. A positioning means is connected to the member to reposition the member and the walling means near the fluid stream. The positioning means may be a biasing means or a gravity means. The positioning means is a return means connected to the member to complete the cycle of operation by returning the walling means to a position near the fluid stream to provide the walling force.

It is an object of this invention to provide a oscillating device with a walling and dewalling means.

Another object of this device is to provide a sprinkler oscillating device that has a drive or oscillating member that is an article containing a walling and dewalling surface.

A further object is to provide an oscillating member with walling and dewalling surfaces and an opening to allow the fluid stream to continue on its original path during the drive cycle.

A further object of this invention is to provide a fluidic hammer anvil drive arm for a sprinkler.

An additional object of this invention is to provide a fluidic sprinkler break up device.

In accordance with these and other objects which will be apparent hereinafter, the instant invention will now be described with particular reference to the accompanying drawings.

DESCRIPTION OF PREFERRED EMBODIMENTS OF THE INVENTION

Figure 1:
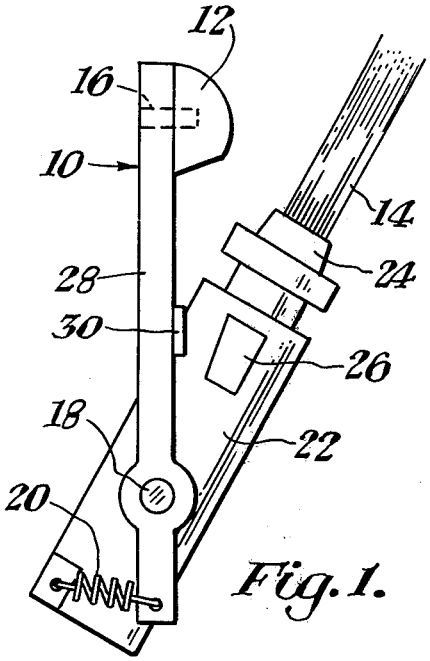
FIG. 1 is a top view of the oscillating mechanism with a movable member on a sprinkler.

This invention relates to a new and improved oscillating arm mechanism as shown in FIG. 1, the oscillating arm mechanism 10 includes a fluid engaging member 12 for walling a portion of the mechanism or device against a fluid stream 14. The fluid sprinkler stream or jet 14 drives the member 12 into the fluid stream. The fluid engaging member 12 is connected to the mechanism 10 by connector 16. The member 12 also reverses the direction of the mechanism or device 10 to drive it out of the fluid stream and dewall it from the fluid stream. The mechanism 10 oscillates about pin 18. A positioning means 20 returns the member to a position near the stream to complete the cycle. The pin 18 is connected to sprinkler 22 having nozzle 24 and anvil 26. The mechanism 10 has arm 28 and hammer 30.

Figure 2:
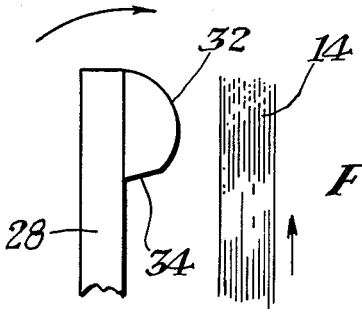
FIG. 2 is a top view of the movable member near the fluid stream from the sprinkler nozzle.
Figure 3:
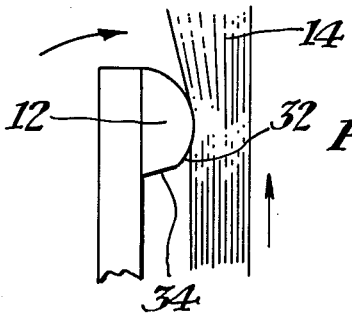
FIG. 3 is a top view of the movable member having walling and dewalling surfaces just engaging the fluid stream from the nozzle.
Figure 4:
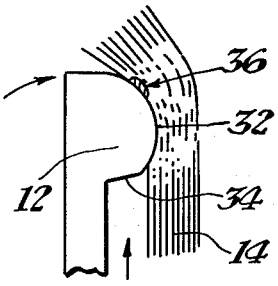
FIG. 4 is a top view of the movable member in FIG. 2 walled in the fluid stream.

The oscillating arm mechanism includes a fluid engaging member or article 12. The member as shown in FIGS. 1 and 2 includes a walling or attraction surface 32 and at least one dewalling or repelling surface 34. The walling surface 32 provides a pressure gradient 36 as shown in FIG. 4 downstream on the walling surface 32. The pressure gradient bends the fluid stream as shown in FIGS. 3 and 4 and walls the member onto the fluid stream surface as shown in FIG. 3 and drives the member into the fluid stream as shown in FIG. 4. The walling force drives the member clockwise as shown in the drawings. The walling force may be created just prior to engagement of the member 12 with the stream. The strength of the walling force is dependent on the curvature of surface 32, the velocity of the stream or jet 14, the mass of the stream, and the mass of the arm 28. The walling force will increase at a rate dependent on the variables as it moves into the stream.

Figure 5:
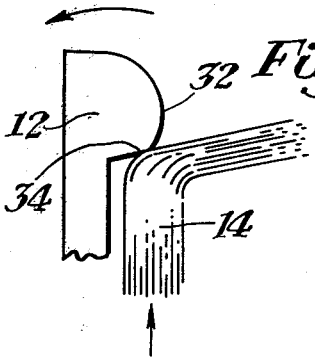
FIG. 5 is a top view of the movable member in FIG. 2 dewalling from the fluid stream.
Figure 6:
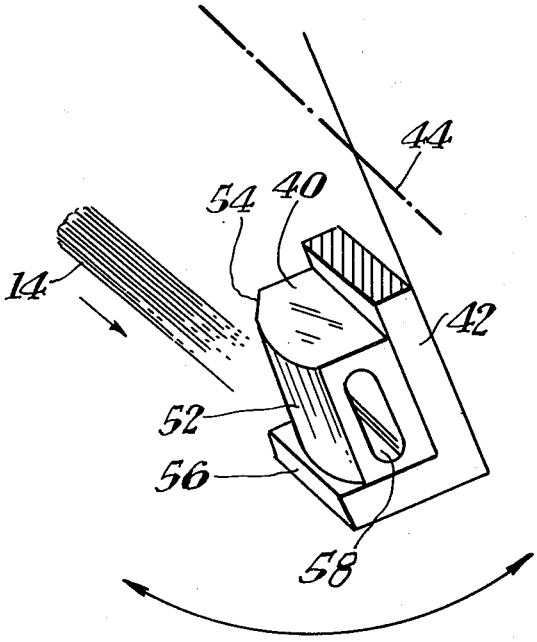
FIG. 6 is an isometric front view of another embodiment of the movable member and a portion of an oscillating mechanism partially in cross section.
Figure 7:
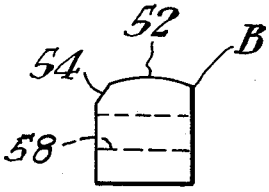
FIG. 7 is a top view of the moving member shown in FIG. 6.

The fluid engaging member also includes a dewalling or repelling surface 34 or surfaces. The repelling surfaces provide a dewalling force and drives the member out of the fluid stream and disengages the member from the stream as shown in FIG. 5. The fluid engaging member 12 is driven by the repelling force to provide energy that is transferred to the positioning means 20 in FIG. 1 to complete the cycle. As the dewalling surface enters the fluid the rate of clockwise movement or the increasing walling force rate will change. As shown the rate of change will decrease. Thereafter, as the member moves into the stream a point will be reached in which a switching effect will occur and a dewalling force will move the member out of the stream.

The positioning or return means is a biasing means or gravity means that provides the member with return oscillating movement to complete the cycle of operation. The oscillating movement may have varied time intervals depending on the size, shape and spacing of the walling and dewalling surfaces, the mass of the member and fluid stream and biasing means design. The oscillating mechanism may be a sprinkler drive means as shown in FIG. 1 utilizing hammer 30 against anvil 26 to rotate the sprinkler 22 clockwise, also the member may be designed to be utilized as a stream interrupter by providing a fast cycle time and removing the hammer 30 and anvil 26.

In another embodiment shown in FIGS. 6, 7, 8 and 9, the oscillating arm mechanism will include the fluid engaging member 40, a movable arm 42, said member 40 connected to one end, a pivot axis 44 on the arm with rotating pin 48 connected to a sprinkler 46. A return biasing means or spring means 50 is connected at 51 to sprinkler 46. The movable arm 42 will normally include a biasing means 50 and/or will be positioned to use gravity to move the arm 42 to a return position to start cycle of operation again. The return position is near the stream. The biasing means 50 may be connected to the arm and the sprinkler to store energy as the arm is moved away from the stream 14. The device then moves back toward the fluid stream by the stored energy in the biasing means 50. Bearings 66 surrounds pin 48.

Figure 8:
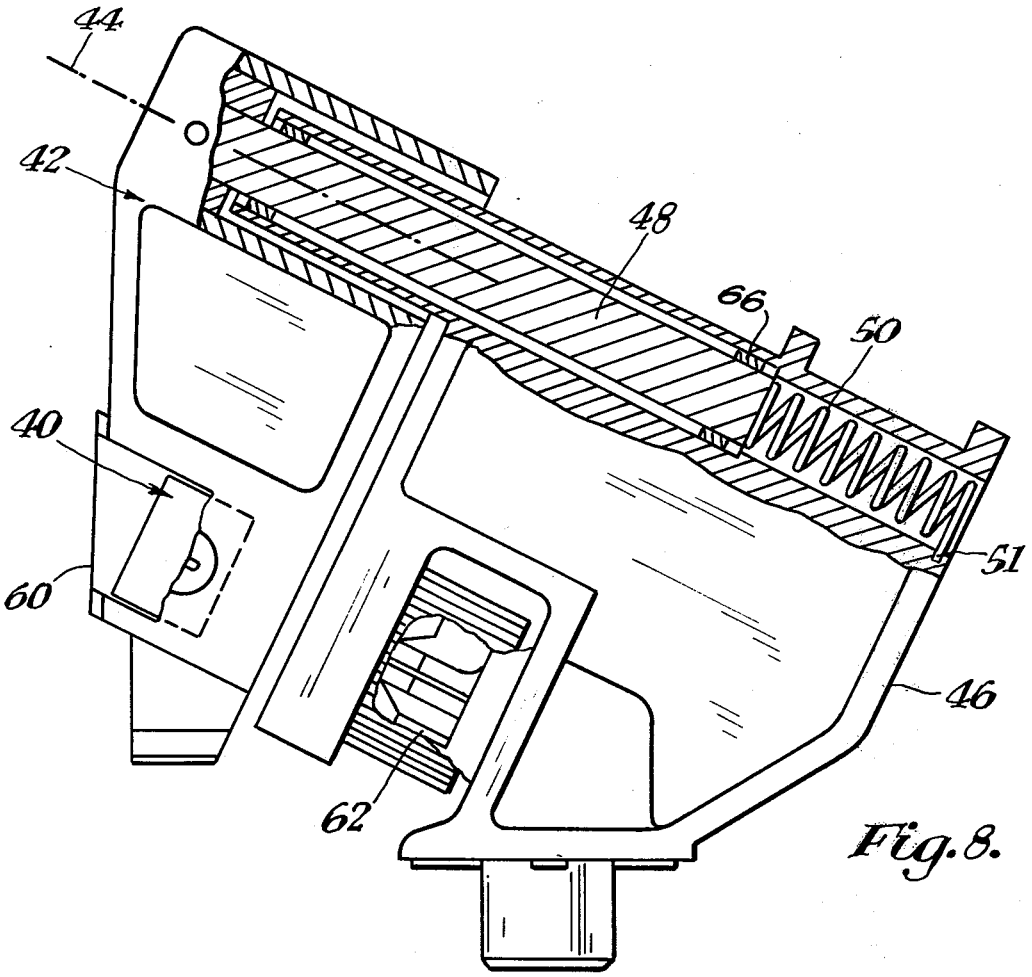
FIG. 8 is a side view of a sprinkler partially in cross section and broken away illustrating the movable member in FIG. 6.
Figure 9:
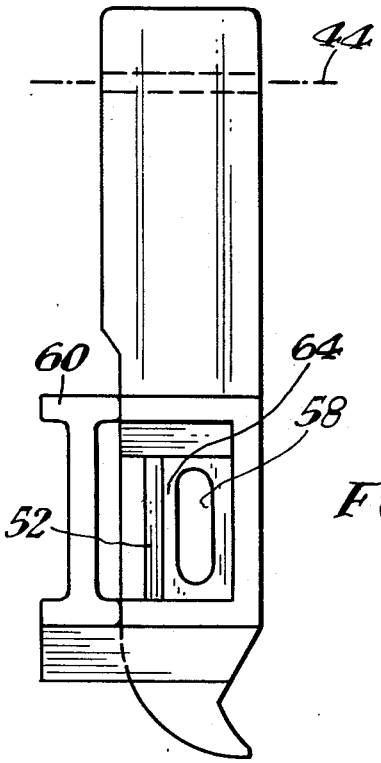
FIG. 9 is a front view of FIG. 8.

The oscillating arm mechanism may be connected to any sprinkler in one of the many well known configurations in order to oscillate back and forth into and out of contact with the fluid sprinkler stream. The fluid engaging member or device 40 in FIG. 8 is connected to the distal end of the arm to position the device for contact with the fluid sprinkler stream exiting the sprinkler nozzle 62. The walling surface is positioned closer to the fluid sprinkler stream than the repelling surface. As the walling surface approaches the fluid stream a low pressure bubble will be created downstream of the initial contact point between the fluid sprinkler stream and the walling surface. This may begin to form just before contact between the fluid stream and the walling surface. The low pressure bubble will create at least a partial vacuum that draws the fluid engaging member or device further into the path of the fluid stream. The repelling surface 54 may be upstream of the walling surface as shown at 52. The repelling surface 54 is drawn into the path of the fluid stream 14. As the fluid stream engages the repelling surface, the walling surface begins to lose its increasing walling force. The repelling force increases to a greater force than the walling surface force to cause the fluid stream to be de-walled from the fluid-engaging device and to be repelled out of the fluid stream in a direction away from the fluid stream along its original incoming path.

It should be noted that the time sequence from the initial engagement of the walling surface and the fluid stream to the time the walling surface reaches its innermost position may be greater than the exiting time of the surfaces.

In addition to the above, the embodiment may be provided with a rather narrow portion at 64 behind the walling surface and repelling surface. The narrow member allows the original fluid stream trajectory to continue in its original direction through opening 58 once the narrow member passed completely into the fluid stream. A portion of the fluid stream will pass on the opposite side of the walling surface and repelling surface to allow the maximum amount of fluid sprinkler stream to continue flowing in its original direction. This particular embodiment will allow the fluid engaging device to enter the stream and to be driven out of the stream without a great deal of fluid loss adjacent the sprinkler. This design will allow a greater quantity of fluid to continue its flow along its original path. This device allows a large quantity of fluid to flow outwardly. The rotary sprinklers disclosed in the Ralph E. Eby U.S. Pat. No. 3,952,953 shows one means of aiding the outward flow of water.

In other embodiments of this invention the repelling surface or repelling surfaces may be placed downstream of the walling surface as well as both downstream and upstream of the walling surface. A plurality of arrangements and combinations of arrangements may be utilized for particular mechanical advantages.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An oscillating device for operation by a fluid stream the improvement comprising:

an oscillating member movable relative to the fluid stream and connected to said device, said member including a walling means on a first side of said member nearest said fluid stream and at least one dewalling means adjacent said walling means on said first side of said member, said walling means connected to said member on said first side to provide a walling force to move said member into engagement with the fluid stream when the member is near the fluid stream and when at least a portion of said walling means is in contact with said fluid stream, said dewalling means connected to said member and moved into the fluid stream by said walling means, said dewalling means providing a dewalling force to stop said member within said fluid stream and to move said member out of said fluid stream in the opposite direction from which it entered, and a positioning means connected to said member to reposition said member and said walling means near the fluid stream so that the cycle of operation may be repeated.

2. An oscillating device for operation by a fluid stream as set forth in claim 1 wherein, said positioning means is a return means connected to said member to complete the cycle of operation by returning said walling means to a position near the fluid stream with at least a portion of said walling means in contact with said fluid stream to provide a walling force pressure gradient.

3. An oscillating device for operation by a fluid stream as set forth in claim 1 wherein, said walling means is a surface and said dewalling means is a surface, said member movable transversely to the longitudinal center line along the trajectory path of said fluid stream into said fluid stream.

4. An oscillating device for operation by a fluid stream as set forth in claim 1 wherein, said member is a fluid stream break up device upon entering into said fluid stream.

5. An oscillating device for operation by a fluid stream as set forth in claim 3 wherein, said dewalling surface is connected upstream in relation to said walling surface, said dewalling surface borders said walling surface, said walling surface positioned in relation to said dewalling surface and the fluid stream for movement of said member toward the fluid stream to first place said walling surface in contact with the fluid stream and thereafter place said adjacent dewalling surface in contact with said stream.

6. In a sprinkler oscillating mechanism including a movable member movable relative to the longitudinal center line of a fluid stream trajectory path from a sprinkler nozzle, a stream attraction means for moving said member into said fluid stream in one direction, and at least one repelling means connected to said member, said stream attraction means and said repelling means for forcing said member into and out of the fluid stream in opposite directions, and a positioning means for placing said stream attraction means in a working position with respect to the fluid stream to move the member into a fluid stream when the member is returned by the positioning means to a working position near the fluid stream, the improvement comprising:

an article including, said stream attraction means having a surface shaped to provide a walling of said member for moving said member into the fluid stream when placed near the fluid stream, and said repelling means is a dewalling means for eliminating walling, said dewalling means having a surface shaped for moving said member out of said fluid stream in the opposite direction from which it entered.

7. In a sprinkler oscillating mechanism as set forth in claim 6 wherein, said attraction means and said repelling means are in generally longitudinal side by side relationship having a common border.

8. In a sprinkler oscillating mechanism as set forth in claim 7 including, a hammer connected to said member, an anvil connected to said sprinkler and positioned to receive blows from said hammer to reposition the sprinkler nozzle.

9. In a sprinkler oscillating mechanism as set forth in claim 8 including, a conduit means for allowing the major portion of the stream to continue in the direction of its original flight when said attraction means and said repelling means are driven into the fluid stream.

* * * * *